US010885872B2

(12) United States Patent
Hsu

(10) Patent No.: US 10,885,872 B2
(45) Date of Patent: Jan. 5, 2021

(54) DISPLAY DEVICE AND SCREEN DISPLAYING METHOD

(71) Applicant: AU Optronics Corporation, Hsin-Chu (TW)

(72) Inventor: Tzu-Hui Hsu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/731,135

(22) Filed: Dec. 31, 2019

(65) Prior Publication Data

US 2020/0265794 A1 Aug. 20, 2020

(30) Foreign Application Priority Data

Feb. 18, 2019 (TW) ..... 108105335 A

(51) Int. Cl.
*G09G 5/00* (2006.01)

(52) U.S. Cl.
CPC ..... *G09G 5/006* (2013.01); *G09G 2310/0275* (2013.01); *G09G 2310/08* (2013.01); *G09G 2320/0204* (2013.01); *G09G 2340/16* (2013.01)

(58) Field of Classification Search
CPC ..... G09G 2310/0275; G09G 2310/08; G09G 2320/0204; G09G 2340/16; G09G 5/006
USPC ..... 345/210–215
See application file for complete search history.

(56) References Cited

U.S. PATENT DOCUMENTS

2006/0103639 A1* 5/2006 Ichiraku ..... G09G 3/2092 345/204
2010/0156881 A1* 6/2010 Kohno ..... G09G 3/3283 345/213
2012/0299974 A1* 11/2012 Park ..... G09G 3/3688 345/690
2015/0206492 A1* 7/2015 Lee ..... G09G 3/3648 345/208
2016/0019826 A1* 1/2016 Kim ..... G09G 3/20 345/214
2016/0035297 A1* 2/2016 Oh ..... G09G 3/3618 345/212
2016/0104427 A1* 4/2016 Matsueda ..... G09G 3/3233 345/212

OTHER PUBLICATIONS

Gabriel Torres, Introducing the Panel Self Refresh Technology, https://www.hardwaresecrets.com/introducing-the-panel-self-refresh-technology/, Sep. 15, 2011 (ref.01, file attached).

* cited by examiner

*Primary Examiner* — Tony O Davis
(74) *Attorney, Agent, or Firm* — WPAT, PC

(57) ABSTRACT

A display device and screen displaying method are provided in this disclosure. The screen displaying method includes the following operations: detecting whether a noise signal on a conducting wire by a detecting unit; outputting a horizontal synchronizing signal and a data signal to a source driving circuit by a timing controller; wherein the data signal includes a first frame data voltage and a second frame data voltage according to the timing sequence; and receiving the first frame data voltage and the second frame data voltage by the source driving circuit, when the detecting unit is configured to detect the noise signal, the processor is configured to selectively output the first frame data voltage or the second frame data voltage.

14 Claims, 6 Drawing Sheets

DISPLAY DEVICE AND SCREEN DISPLAYING METHOD

CROSS-REFERENCE TO RELATED APPLICATION

This application claims priority to Taiwanese Application Serial Number 108105335, filed on Feb. 18, 2019, which is herein incorporated by reference.

BACKGROUND

Field of Invention

The present invention relates to a display device and screen displaying method. More particularly, the present invention relates to a display device and screen displaying method for selecting the display screen according to an outer signal.

Description of Related Art

With the rapid development of display technology, the mobile phones have been widely used in human's lives. However, because the transmission of the mobile phone is utilized the high-frequency antennas, the signal transmitted from the timing controller to the source driver IC will be interfered, when the mobile phone is near the display device. Moreover, the timing controller outputs a normal signal. The signal received by the source driver IC is interfered, so as to cause the abnormal condition in display. Therefore, the timing controller cannot detect the abnormal signal outputted by the source driver IC, and it will cause the display problems such as flickering and bright lines on the display.

SUMMARY

The invention provides a display device. The display device comprises a plurality of data lines, a conducting wire, a timing controller and a source driving circuit. The driving circuit is configured to output a horizontal synchronizing signal and a data signal, wherein the data signal comprises a first frame data voltage and a second frame data voltage according to a timing sequence. The source driving circuit is electrically coupled to the conducting wire, the timing controller and the plurality of data lines. The source driving circuit is configured to receive the horizontal synchronizing signal and the data signal, wherein the source driving circuit comprises a detecting unit and a processor. The detecting unit is electrically coupled to the conducting wire, and the detecting unit is configured to detect whether a noise signal on the conducting wire. The processor is electrically coupled to the detecting unit, and the processor is configured to receive the first frame data voltage and the second frame data voltage, when the detecting unit is configured to detect the noise signal, the processor is configured to selectively output one of the first frame data voltage and the second frame data voltage.

The invention provides a screen displaying method. The screen displaying method includes operations of: detecting whether a noise signal on a conducting wire by a detecting unit; outputting a horizontal synchronizing signal and a data signal to a source driving circuit by a timing controller, wherein the data signal comprises a first frame data voltage and a second frame data voltage according to a timing sequence; and receiving the first frame data voltage and the second frame data voltage by the source driving circuit, when the detecting unit is configured to detect the noise signal, the source driving circuit is configured to selectively output one of the first frame data voltage and the second frame data voltage.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
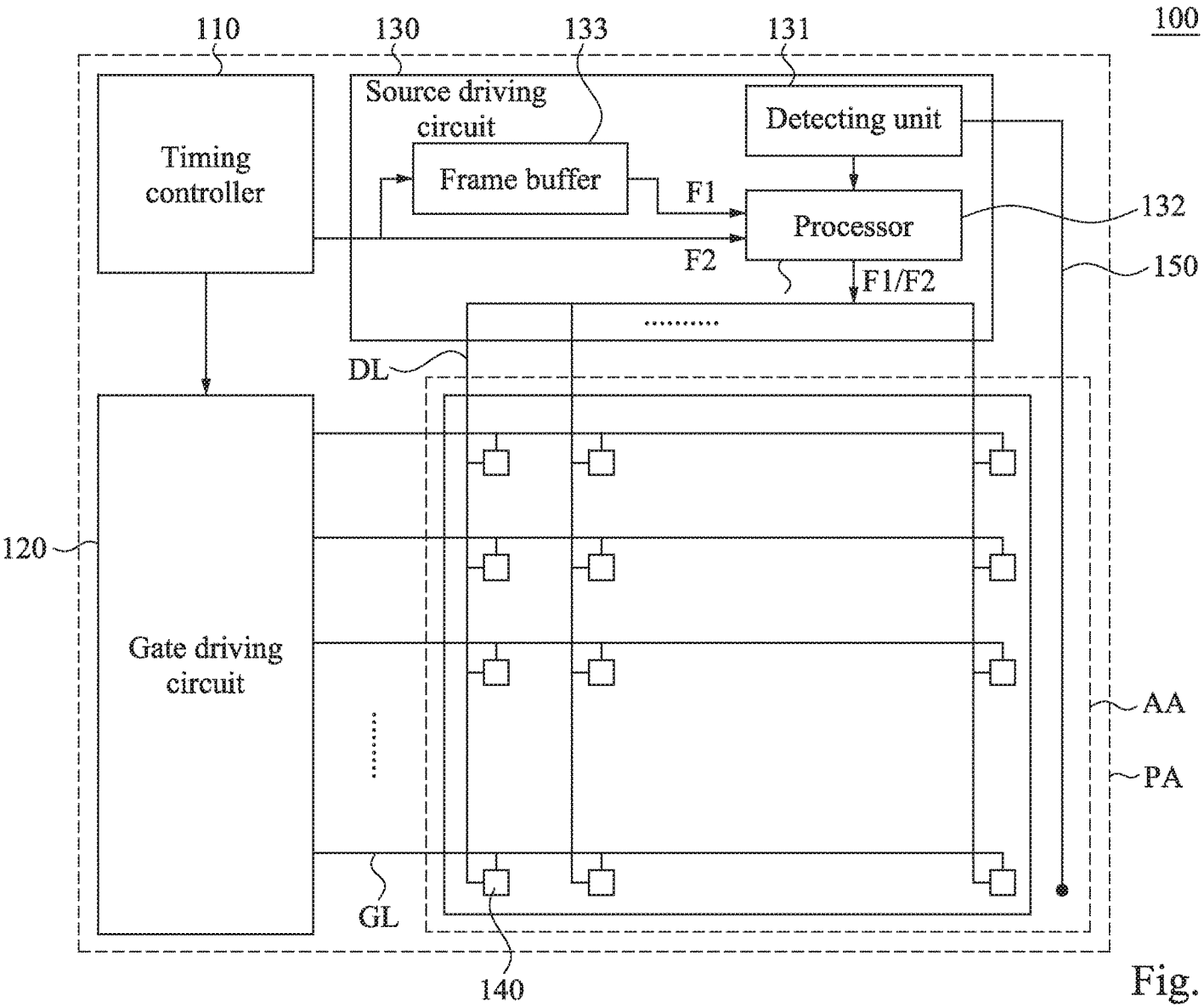
FIG. 1 is a functional block diagram of a display device according to one embodiment of the present disclosure.

Reference will now be made in detail to the present embodiments of the invention, examples of which are illustrated in the accompanying drawings. Wherever possible, the same reference labels are used in the drawings and the description to refer to the same or like parts, components, or operations.

FIG. 1 is a functional block diagram of a display device 100 according to one embodiment of the present disclosure. As shown in FIG. 1, the display device 100 includes a timing controller 110, a gate driving circuit 120, a source driving circuit 130, a pixel circuit 140, a plurality of data lines DL, a plurality of gate lines GL and a conducting wire 150. The timing controller 110 is electrically connected to the gate driving circuit 120 and the source driving circuit 130. The gate driving circuit 120 is electrically connected to the gate lines GL, and the source driving circuit 130 is electrically connected to the data lines DL. The source driving circuit 130 includes the detecting unit 131, the processor 132 and a frame buffer 133. The detecting unit 131 is electrically connected to the processor 132 and the conducting wire 150, and the frame buffer 133 is electrically connected to the processor 132.

In the embodiment, the timing controller 110 is configured to output a horizontal synchronizing signal and a data signal. The source driving circuit 130 is configured to receive the horizontal synchronizing signal and the data signal. The data signal includes a first frame data voltage F1 and a second frame data voltage F2 according to a timing sequence. The frame buffer 133 is configured to store the first frame data voltage F1 and provide the first frame data voltage F1 to the processor 132. The detecting unit 131 is configured to detect whether a noise signal on the conducting wire 150. The processor 132 is configured to receive the first frame data voltage F1 and the second frame data voltage F2. When the detecting unit 131 is configured to detect the noise signal on the conducting wire 150, the processor 132 is configured to selectively output one of the first frame data voltage F1 and the second frame data voltage F2.

Figure 2B:
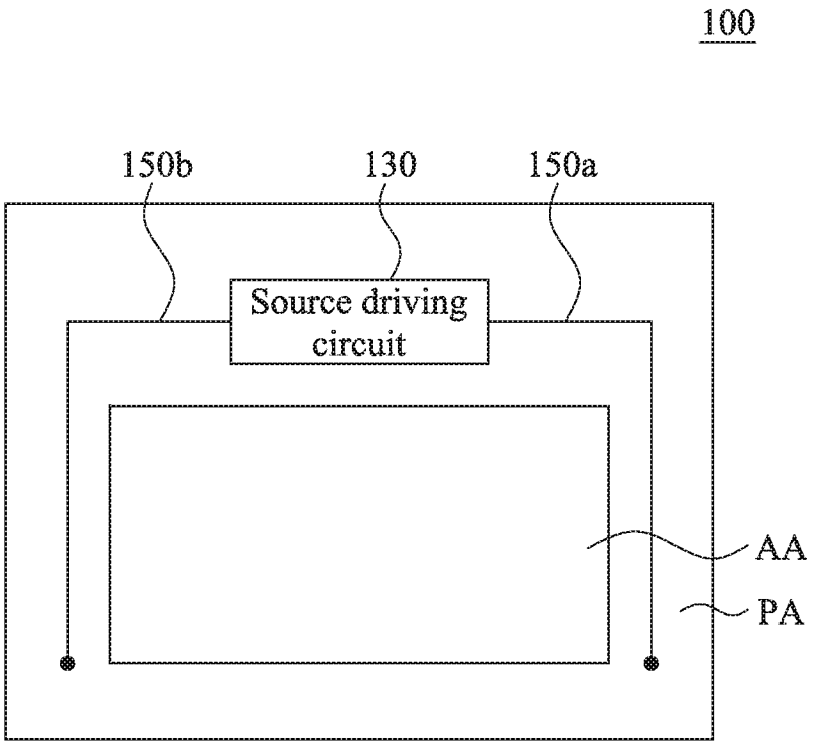
FIG. 2B is schematic diagrams illustrating the display device according to some embodiments of this disclosure.
Figure 2A:
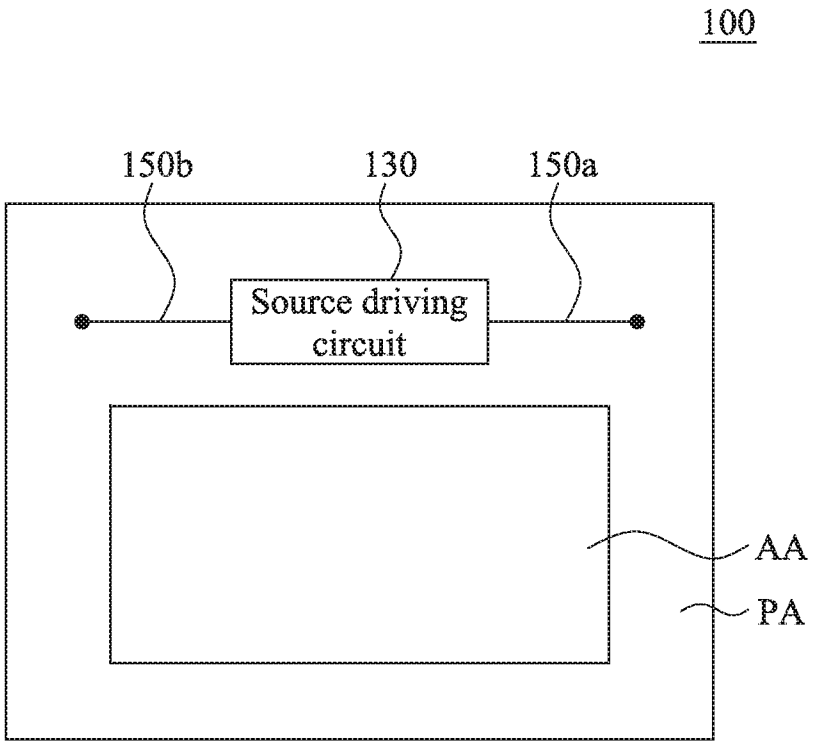
FIG. 2A is schematic diagrams illustrating the display device according to some embodiments of this disclosure.
Figure 2C:
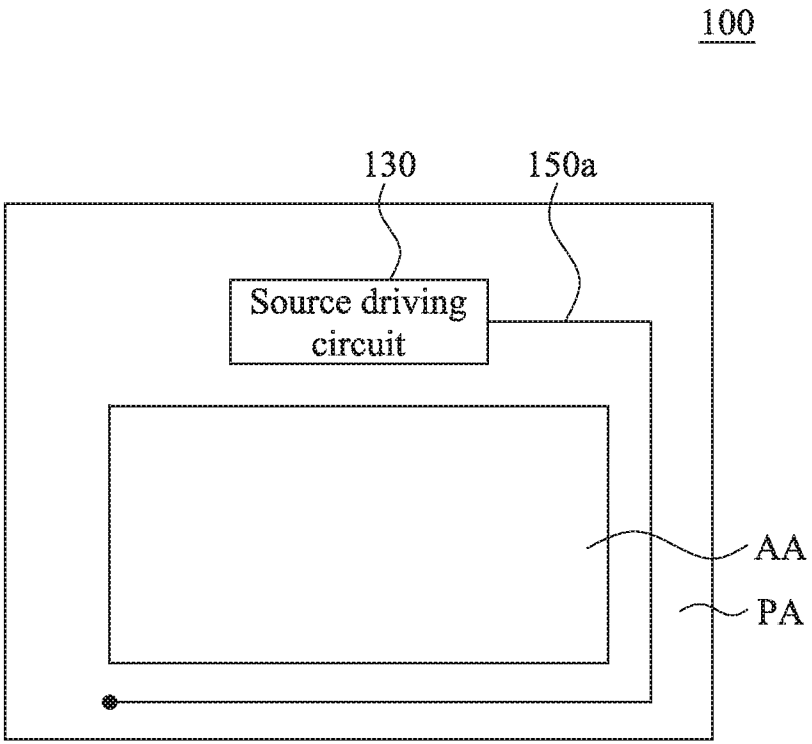
FIG. 2C is schematic diagrams illustrating the display device according to some embodiments of this disclosure.

In the embodiment, as shown in FIG. 1, the display device 100 includes an active area AA and a peripheral area PA. The pixel circuit 140 is disposed in the active area AA. The timing controller 110, the gate driving circuit 120, the source driving circuit 130, and the conducting wire 150 are disposed in the peripheral area PA. Reference is made to FIG. 2A to FIG. 2C. FIGS. 2A-2C are schematic diagrams illustrating the display device according to some embodiments of this disclosure. The source driving circuit 130 and the conducting wires 150*a* and 150*b* are shown in FIGS. 2A-2C, and the timing controller 110, the gate driving circuit 120 and the pixel circuit 140 do not shown in FIGS. 2A-2C. As shown in FIGS. 2A-2C, the shape of the conducting wire 150*a* can be implemented by an I-type, a L-type or U-type. The shape of the conducting wire 150*b* can be implemented by the I-type or U-type. The amount of the conducting wires shown in FIGS. 2A-2C is only as the embodiments, and the amount of the conducting wires 150*a* and 150*b* are not limited thereto.

Figure 3:
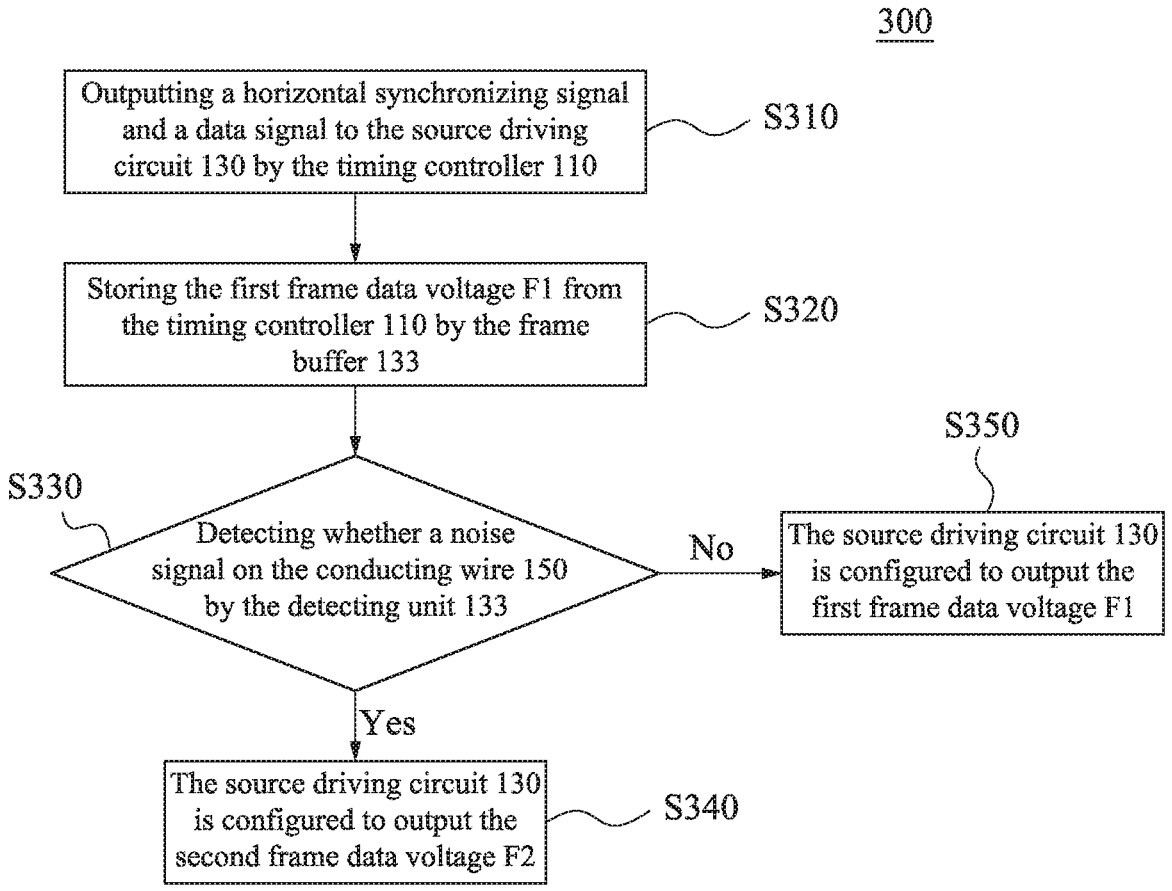
FIG. 3 is a flow diagram illustrating a screen displaying method according to an embodiment of this disclosure.

Reference is made to FIG. 1 to FIG. 3. FIG. 3 is a flow diagram illustrating a screen displaying method 300 according to an embodiment of this disclosure. In the embodiment, the screen displaying method 300 can be applied to the display device 100 of FIGS. 1, 2A-2C. The processor 132 is configured to selectively output one of the first frame data voltage F1 and the second frame data voltage F2 according to the steps described in the following screen displaying method 300.

As shown in FIG. 3, the screen displaying method 300 firstly executes step S310 outputting a horizontal synchronizing signal and a data signal to the source driving circuit 130 by the timing controller 110, and further executes step S320 storing the first frame data voltage F1 from the timing controller 110 by the frame buffer 133. In the embodiment, the data signal includes the first frame data voltage F1 and the second frame data voltage F2 according to a timing sequence. The timing controller 110 is configured to output the horizontal synchronizing signal and the data signal to the source driving circuit 130, continuously. The source driving circuit 130 is configured to transmit the data signal to the pixel circuit via the data lines. The frame buffer 133 is configured to store the previous frame data voltage. It can be seen that the first frame data voltage F1 is the previous frame data voltage of the second frame data voltage F2.

Afterwards, the screen displaying method 300 executes step S330 detecting whether a noise signal on the conducting wire 150 by the detecting unit 131. In the embodiment, the detecting unit 131 is configured to detect whether the noise signal on the conducting wire 150, continuously. When a device with high frequency electromagnetic waves (e.g. smart phone) is near the wire 150, the conducting wire 150 is configured to generate a detecting signal through the capacitive coupling effect and transmit to the detecting unit 131.

Afterwards, the screen displaying method 300 executes step S340 when the processor 132 is configured to receive the second frame data voltage F2, if the detecting unit 131 detects the noise signal on the conducting wire 150, the source driving circuit 130 is configured to output the first frame data voltage F1. In the embodiment, when the processor 132 receives the second frame data voltage F2, and the detecting unit 131 detects the noise signal generated by the conducting wire 150, the processor 132 is configured to hold the second frame data voltage F2 and output the first frame data voltage F1.

Afterwards, the screen displaying method 300 executes step S350 when the detecting unit 131 does not detect the noise signal on the conducting wire 150, the source driving circuit 130 is configured to output the second frame data voltage F2. In the embodiment, when the processor 132 receives the second frame data voltage F2 and the detecting unit 131 does not detect the noise signal, the source driving circuit 130 can directly output the second frame data voltage F2.

Figure 4:
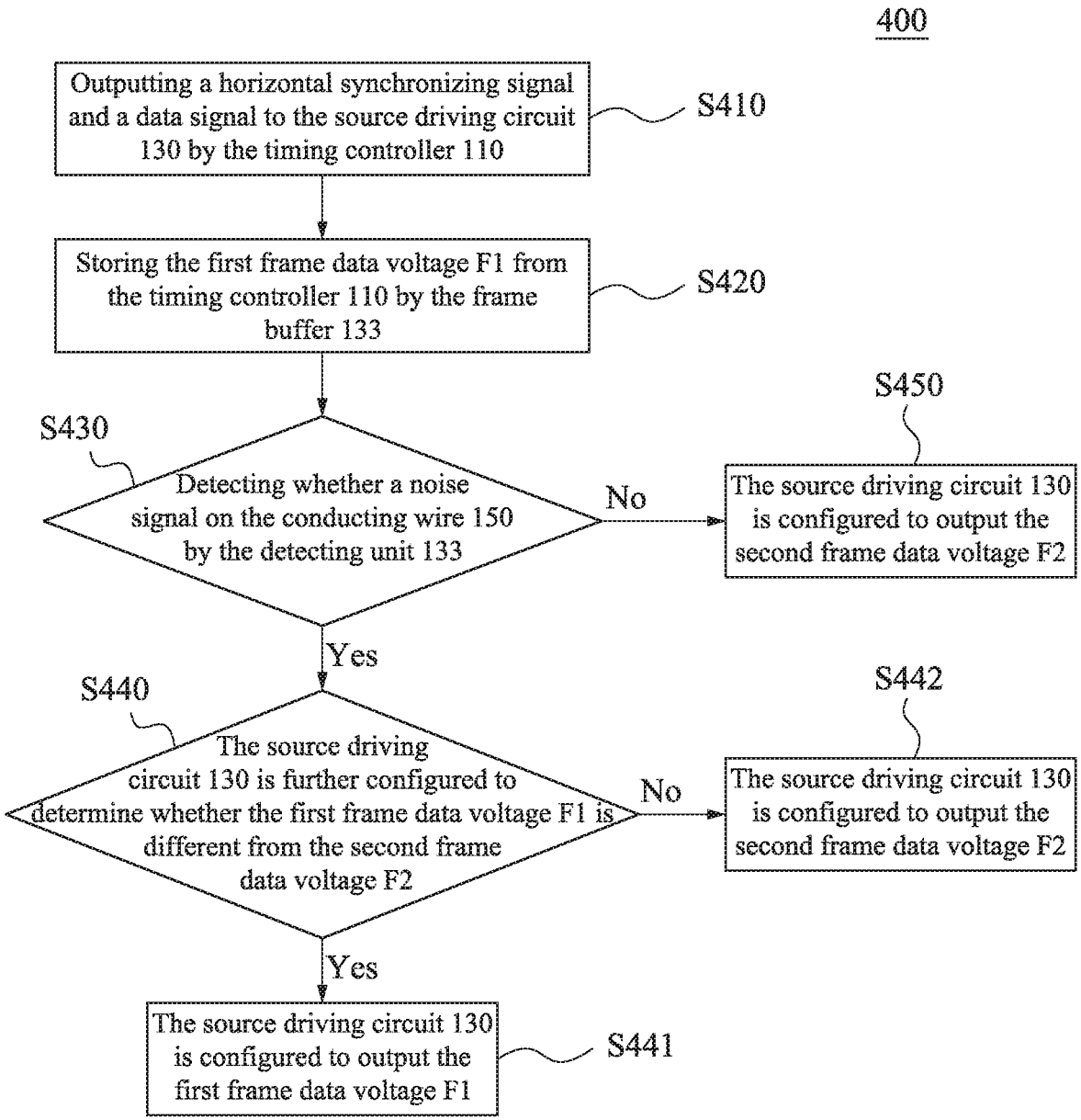
FIG. 4 is a flow diagram illustrating a screen displaying method according to an embodiment of this disclosure.

In another embodiment, reference is made to FIG. 4. FIG. 4 is a flow diagram illustrating a screen displaying method 400 according to an embodiment of this disclosure. In the embodiment, the screen displaying method 400 can be applied to the display device 100 of FIGS. 1, 2A-2C. The steps S410~S430 of the screen displaying method 400 are the same as the steps S310~S330. For the sake of brevity, those descriptions will not be repeated here. As shown in FIG. 4, when the detecting unit 131 detects the noise signal on the conducting wire 150, the screen displaying method 400 further executes step S440, the source driving circuit 130 is further configured to determine whether the first frame data voltage F1 is different from the second frame data voltage F2. In the embodiment, the processor 132 is configured to compare whether the first frame data voltage F1 and the second frame data voltage F2 are consistent.

Afterwards, the screen displaying method 400 further executes step S441 if the first frame data voltage F1 is different from the second frame data voltage F2, the source driving circuit 130 is configured to output the first frame data voltage F1. In the embodiment, the difference between the first frame data voltage F1 and the second frame data voltage F2 is represented that the frame between previous frame and current frame is different. In this case, because the detecting unit 131 detects the noise signal and the first frame data voltage F1 is different from the second frame data voltage F2, the second frame data voltage F2 may be an abnormal frame disturbed by noise signal. Therefore, the source driving circuit 130 outputs the first frame data voltage F1 instead of the second frame data voltage F2.

Afterwards, the screen displaying method 400 further executes step S442 if the first frame data voltage F1 is equal to the second frame data voltage F2, the source driving circuit 130 is configured to output the second frame data voltage F2. In the embodiment, the first frame data voltage F1 is the same as the second frame data voltage F2, which means that the previous frame is equal to the current frame. In this case, because the first frame data voltage F1 is equal to the second frame data voltage F2, the source driving circuit 130 outputs the second frame data voltage F2.

Afterwards, when the detecting unit 131 does not detect the noise signal on the conducting wire 150, the screen displaying method 400 executes the step S450, and the operation of the step S450 is similar with the operation of the step S350. For the sake of brevity, those descriptions will not be repeated here.

Figure 5:
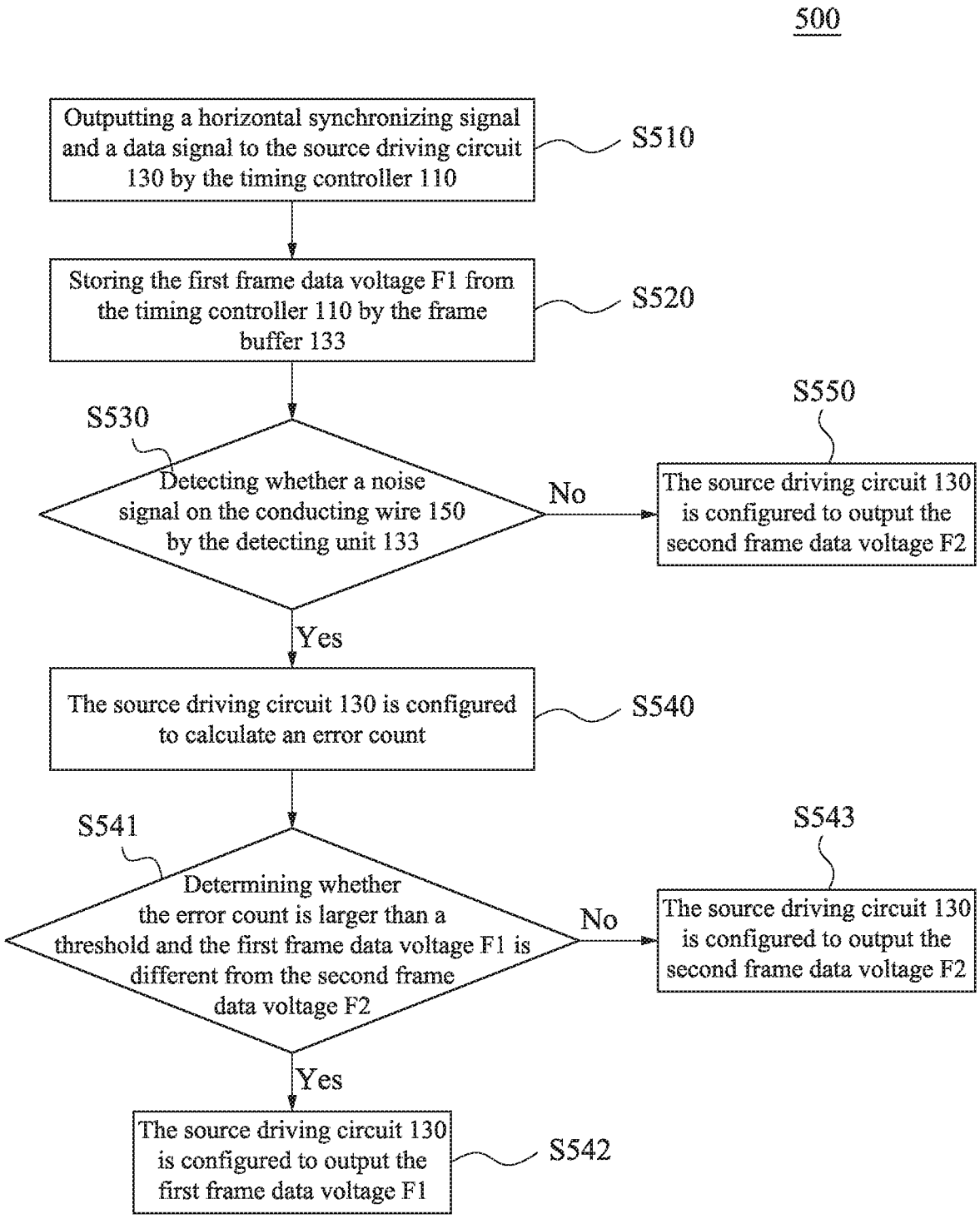
FIG. 5 is a flow diagram illustrating a screen displaying method according to an embodiment of this disclosure.

In another embodiment, reference is made to FIG. 5. FIG. 5 is a flow diagram illustrating a screen displaying method 500 according to an embodiment of this disclosure. In the embodiment, the screen displaying method 500 can be applied to the display device 100 of FIGS. 1, 2A-2C. The steps S510~S530 of the screen displaying method 500 are the same as the steps S310~S330. For the sake of brevity, those descriptions will not be repeated here. As shown in FIG. 5, when the detecting unit 131 detects the noise signal on the conducting wire 150, the screen displaying method 500 further executes step S540, the source driving circuit 130 is configured to calculate an error count. In the embodiment, when the detecting unit 131 detects the noise signal on the conducting wire 150, the processor 132 is configured to calculate the error count. The error count is generated by calculating the amount of noise or errors generated inside the source driving circuit 130. In this case, the error count is utilized to determine whether the high-frequency noise signal is generated.

Afterwards, the screen displaying method 500 further executes steps S541 and S542, determining whether the error count is larger than a threshold and the first frame data voltage F1 is different from the second frame data voltage F2, if the error count is larger than the threshold and the first frame data voltage F1 is different from the second frame data voltage F2, the source driving circuit 130 is configured to output the first frame data voltage F1. In this case, because the detecting unit 131 detects the noise signal on the conducting wire 150, the determination of the error count and the determination of the first frame data voltage F1 and the second frame data voltage F2 are established at the same time. The operation of the step S541 can further confirm the occurrence of high-frequency noise signal interference, thereby reducing the probability of false determination.

Afterwards, the screen displaying method 500 further executes step S543 if the error count is less than or equal to the threshold, the source driving circuit 130 is configured to output the second frame data voltage F2. In this case, the detecting unit 131 detects the noise signal on the conducting wire 150, however the error count is less than or equal to the threshold. Then, the processor 132 determines the high-frequency noise signal interference does not happened, and thus the processor 132 outputs the second frame data voltage F2.

Afterwards, when the detecting unit 131 does not detect the noise signal on the conducting wire 150, the screen displaying method 500 executes the step S550, and the operation of the step S550 is similar with the operation of the step S350. For the sake of brevity, those descriptions will not be repeated here.

As can be appreciated from the foregoing embodiments, when the high-frequency noise signal interference is happened, the processor of the source driving circuit determines whether the frame between previous frame and current frame is different or calculates the error count. The source driving circuit selectively output the previous frame data voltage to the data lines by determining whether the data voltages between previous frame and current frame is the same or determining whether the error is larger than the threshold. Therefore, the disclosure is capable of displaying the normal screen under the interference of high-frequency signals.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention indicated by the following claims.

What is claimed is:

1. A display device, comprising:

a plurality of data lines;

a conducting wire;

a timing controller, configured to output a horizontal synchronizing signal and a data signal, wherein the data signal comprises a first frame data voltage and a second frame data voltage according to a timing sequence; and a source driving circuit, electrically coupled to the conducting wire, the timing controller and the plurality of data lines, configured to receive the horizontal synchronizing signal and the data signal, wherein the source driving circuit comprises:

a detecting unit, electrically coupled to the conducting wire, configured to detect whether a noise signal on the conducting wire;

a processor, electrically coupled to the detecting unit, configured to receive the first frame data voltage and the second frame data voltage, when the detecting unit is configured to detect the noise signal, the processor is configured to selectively output one of the first frame data voltage and the second frame data voltage;

wherein when the detecting unit detects the noise signal on the conducting wire, the processor is configured to determine whether the first frame data voltage is different from the second frame data voltage to selectively output one of the first frame data voltage and the second frame data voltage.

2. The display device of claim 1, wherein when the processor is configured to receive the second frame data voltage, if the detecting unit detects the noise signal on the conducting wire, the processor is configured to output the first frame data voltage.

3. The display device of claim 1, wherein if the first frame data voltage is different from the second frame data voltage, the processor is configured to output the first frame data voltage; if the first frame data voltage is equal to the second frame data voltage, the processor is configured to output the second frame data voltage.

4. The display device of claim 1, wherein when the detecting unit detects the noise signal on the conducting wire, the processor is configured to calculate an error count; when the error count is larger than a threshold and the first frame data voltage is different from the second frame data voltage, the processor is configured to output the first frame data voltage.

5. The display device of claim 1, wherein when the detecting unit does not detect the noise signal on the conducting wire, the processor is configured to output the second frame data voltage.

6. The display device of claim 1, the source driving circuit, further comprising:

a frame buffer, configured to store the first frame data voltage and provide the first frame data voltage to the processor.

7. The display device of claim 1, wherein the first frame data voltage is previous frame data voltage of the second frame data voltage.

8. A screen displaying method, comprising:

detecting whether a noise signal on a conducting wire by a detecting unit;

outputting a horizontal synchronizing signal and a data signal to a source driving circuit by a timing controller, wherein the data signal comprises a first frame data voltage and a second frame data voltage according to a timing sequence; and receiving the first frame data voltage and the second frame data voltage by the source driving circuit, when the detecting unit is configured to detect the noise signal, the source driving circuit is configured to selectively output one of the first frame data voltage and the second frame data voltage;

when the detecting unit detects the noise signal on the conducting wire, the source driving circuit is configured to determine whether the first frame data voltage is different from the second frame data voltage to selectively output one of the first frame data voltage and the second frame data voltage.

9. The screen displaying method of claim 8, wherein when the source driving circuit is configured to receive the second frame data voltage, if the detecting unit detects the noise signal on the conducting wire, the source driving circuit is configured to output the first frame data voltage.

10. The screen displaying method of claim 8, further comprising:

if the first frame data voltage is different from the second frame data voltage, the source driving circuit is configured to output the first frame data voltage; and if the first frame data voltage is equal to the second frame data voltage, the source driving circuit is configured to output the second frame data voltage.

11. The screen displaying method of claim 8, further comprising:

when the detecting unit detects the noise signal on the conducting wire, the source driving circuit is configured to calculate an error count;

if the error count is larger than a threshold and the first frame data voltage is different from the second frame data voltage, the source driving circuit is configured to output the first frame data voltage; and if the error count is less than or equal to the threshold, the source driving circuit is configured to output the second frame data voltage.

12. The screen displaying method of claim 8, wherein when the detecting unit does not detect the noise signal on the conducting wire, the source driving circuit is configured to output the second frame data voltage.

13. The screen displaying method of claim 8, further comprising:

storing the first frame data voltage from the timing controller by a frame buffer.

14. The screen displaying method of claim 8, wherein the first frame data voltage is previous frame data voltage of the second frame data voltage.

* * * * *